United States Patent [19]

Brisco et al.

[11] Patent Number: 4,662,446

[45] Date of Patent: May 5, 1987

[54] LINER SEAL AND METHOD OF USE

[75] Inventors: David P. Brisco, Duncan, Okla.; Michael L. Bolin, Knoxville, Tenn.

[73] Assignee: Halliburton Company, Duncan, Okla.

[21] Appl. No.: 820,764

[22] Filed: Jan. 16, 1986

[51] Int. Cl.[4] ..... E21B 43/10

[52] U.S. Cl. ..... 166/278; 166/51

[58] Field of Search ..... 166/278, 51, 180, 187, 166/205, 377, 369, 381, 126, 128

[56] References Cited

U.S. PATENT DOCUMENTS

| | | | |
|---|---|---|---|
| 2,927,640 | 3/1960 | Kenneday | 166/51 |
| 3,524,501 | 8/1970 | Armstrong | 166/182 |
| 3,987,854 | 10/1976 | Callihan et al. | 166/51 X |
| 4,270,608 | 6/1981 | Hendrickson et al. | 166/278 |
| 4,273,190 | 6/1981 | Baker et al. | 166/278 |
| 4,295,524 | 10/1981 | Baker et al. | 166/278 |
| 4,418,754 | 12/1983 | Stepp | 166/278 |
| 4,541,484 | 9/1985 | Salerni et al. | 166/51 X |
| 4,583,593 | 4/1986 | Zunkel et al. | 166/278 X |

*Primary Examiner*—Stephen J. Novosad
*Assistant Examiner*—Thuy M. Bui
*Attorney, Agent, or Firm*—Joseph A. Walkowski

[57] ABSTRACT

A liner seal for use in a tool string for sealing above a gravel pack around a liner screen. The liner seal is originally positioned in the tool string between the liner screen and a release mechanism. The release mechanism is a pressure actuated, non-rotational type having collets engaged with a portion of the liner seal. Gravel is packed around the liner screen, and the release mechanism is actuated. Setting weight on an outer sleeve of the liner seal downwardly moves the outer sleeve with respect to an inner sleeve attached to the liner screen. This relatively converging movement of the outer and inner sleeves radially outwardly displaces a seal member into sealing engagement with the well bore. A shear pin is included so that a predetermined load is required for downwardly moving the outer sleeve. A slip is provided to prevent upward movement of the outer sleeve, thus preventing disengagement of the seal member with the well bore. The liner seal sealingly encloses an upper end of an annular volume around the liner screen, and prevents upward migration of a gravel pack in the annular volume. After the liner seal is released and set, the tool string may be removed from the hole. An additional trip for setting a separate liner seal is eliminated.

14 Claims, 7 Drawing Figures

LINER SEAL AND METHOD OF USE

BACKGROUND OF THE INVENTION

1. Field of the Invention

This invention relates to a liner seal for use with a liner or gravel screen, and more particularly, to a liner seal which forms a part of a tool string and which interconnects the liner screen with a releasing mechanism on the tool string.

2. Description of the Prior Art

Positioning liner screens and packing gravel therearound in a well bore is known in the art. Typically, the liner screen is at the bottom of a tool string, releasably disposed at a point below a gravel packer. After the gravel packing operation, the gravel packer is unset, and the tool string is detached from the liner screen. The gravel pack keeps the liner screen positioned. The tool string is removed from the well, and it is then necessary to lower a liner seal into the well bore above the liner screen and the gravel pack. The liner seal is then set for sealing engagement with the well bore for preventing migration of the gravel pack up the well annulus.

The apparatus of the present invention eliminates the step of removing the drill string and lowering the liner seal in that the present invention includes a liner seal releasably attached to the tool string originally lowered into the hole. After the gravel packing operation, the liner seal can be released from the tool string and set to its sealing position. The tool string is then removed from the well, and a separate operation of lowering a liner seal after packing is eliminated. This greatly reduces the cost and time involved in a gravel pack operation.

The releasing mechanism used in the present invention is a pressure actuated, non-rotational collet releasing device. Such a non-rotational releasing mechanism is disclosed in pending application Ser. No. 756,892, assigned to the assignee of the present invention.

SUMMARY OF THE INVENTION

The liner seal of the present invention forms a portion of a downhole tool comprising a liner or gravel screen portion for location at a predetermined position in a well bore, the liner screen portion being attached to a lower end of the liner seal portion, and a rleasing mechanism for attaching the liner seal portion to a tool string and nonrotationally releasing the liner seal portion from the tool string. After release, the tool string may be removed from the well bore with the liner seal and liner screen portions remaining positioned in the well bore. The liner seal portion defines a set position for sealing engagement with the well bore for sealing an upper portion of an annular volume between the liner screen portion and the well bore.

The liner seal portion comprises outer sleeve means and inner sleeve means extending from the outer sleeve means, one of the outer and inner sleeve means being attached to the liner or gravel screen portion. The outer and inner sleeve means are relatively slidable from a normally extended position to a relatively converged position. The liner seal portion further comprises annular seal means having a first end engaged with the outer sleeve means and a second end engaged with the inner sleeve means. The seal means is radially outwardly displaced into sealing engagement with the well bore when the outer and inner sleeve means are in the relatively converted position.

In the preferred embodiment, the inner sleeve means is characterized by an inner sleeve having a lower end connected to the liner screen portion and an upper end. The outer sleeve means is characterized as an outer sleeve slidingly disposed around the inner sleeve upper end. The seal means is characterized by an annular sealing member with its first end being an upper end attached to a lower end of the outer sleeve. The second end of the sealing member is a lower end which is attached to the inner sleeve at an intermediate position thereon. As the outer sleeve is slidingly moved from an original position to a relatively converged position which corresponds to the set position of the liner seal portion, the upper and lower ends of the annular sealing member are moved toward one another, thus radially outwardly displacing the annular sealing member into engagement with the well bore.

The apparatus further comprises shear means for maintaining the outer and inner sleeve means in the extended position, so that a predetermined load relatively applied between the outer and inner sleeve means is required for movement to the relatively converged position. The shear means is preferably a shear pin interconnecting the inner and outer sleeves which is sheared when sufficient load is placed on the outer sleeve.

Slip means are provided for lockably holding the outer and inner sleeve means in the relatively converged position. In the preferred embodiment, the slip means is characterized by an annularly disposed slip which allows for sliding movement from the extended position to the relatively converged position, but which prevents reverse movement between the outer and inner sleeves. This maintains the sealing member in sealing engagement with the well bore.

Sealing means, such as an O-ring, is provided between the outer and inner sleeve means for preventing fluid communication between the inside of the liner seal with the annular volume outside of the liner seal.

The releasing mechanism provides a means of releasing the liner seal portion, and thus the liner screen portion, so that the liner seal and screen assembly is left in the well bore when the tool string is removed. This nonrotational releasing means comprises collet receiving means defined on one of the outer and inner sleeve means of the liner seal portion and collet means on the tool string portion. At least a portion of the collet means is positionable adjacent the collet receiving means and preferably are normally biased away from engagement with the collet receiving means, although non-biased collet means may be used. The releasing means further comprises mandrel means for biasing the collet means into engagement with the collet receiving means when in a conecting or engaging position and for releasing the collet means from this engagement when the mandrel means is moved to a releasing position.

In the preferred embodiment, the collet receiving means is characterized by an annular collet receiving groove in an inside surface of the inner sleeve. The collet means includes a body portion attached to the tool string and which has a plurality of collet fingers extending downwardly therefrom. In the preferred embodiment, the collet fingers are inwardly biased. Each collet finger defines an enlarged collet portion, each collet portion being positioned adjacent the groove when in the original position.

The mandrel means preferably includes a releasing mandrel slidably positioned in the body portion and which has a collet displacing portion at a lower end thereof for outwardly displacing the collet portions to a first position in engagement with the groove when in the engaging position of the mandrel. As the releasing mandrel is moved downwardly to a releasing position, the collet displacing portion is moved away from the collet portions such that the biased collet portions automatically move radially inwardly to a second position disengaged from the groove. Once the collet portions are disengaged, the liner seal is thus released from the tool string.

The preferred embodiment of the releasing mechanism further comprises shear means in the form of a shear pin between the body portion and the releasing mandrel such that a predetermined force is required for moving the releasing mandrel from its engaging position to the releasing position.

The releasing mechanism further comprises shoulder means between the body portion and the releasing mandrel which limits maximum relative movement between the body portion and the releasing mandrel.

In addition to releasably connecting the liner seal to a lower end of a tool string and positioning the liner screen at a lower end of the liner seal, a method of using the apparatus for positioning and packing the liner screen in a well bore comprises the steps of lowering the tool string in the well bore and locating the screen at a predetermined position, packing gravel below the liner seal in an annular volume between the screen and the well bore, releasing the liner seal from the tool string, setting the liner seal for sealing engagement with the well bore and thereby sealingly enclosing an upper portion of the annular volume around the screen, and preventing disengagement of the liner seal from the well bore.

The step of releasing the liner seal preferably comprises a step of applying pressure to a pressure actuated release mechanism interconnecting the liner seal with the lower end of the tool string. This step of applying pressure to the release mechanism moves the mandrel and thus displaces the collets from the first position engaging the liner seal to the second position releasing the liner seal, as hereinbefore described.

Preferably, the step of setting the liner seal comprises setting weight on the outer sleeve for longitudinal displacement thereof with respect to the inner sleeve, and thus radially deflecting the sealing member on the liner seal into sealing engagement with the well bore.

An important object of the present invention is to provide a liner seal and screen apparatus attachable as a unit to a tool string, thus eliminating a separate positioning of a liner screen.

Another object of the invention is to provide an apparatus having a liner seal portion and a liner or gravel screen portion wherein the liner seal portion includes relatively slidable inner and outer sleeve means, which when moved to a relatively converged position, forces an annular seal means into engagement with a well bore.

A further object of the invention is to provide a downhole tool which includes a liner seal attached to an upper end of a liner screen and connected to a lower end of a tool string by a non-rotational releasing mechanism which may be actuated to release the liner seal from the tool string.

Still another object of the invention is to provide a method of positioning and packing a liner screen in a well bore in which a liner seal is included as a portion of the original tool string and which can be set after a packing operation.

Additional objects and advantages of the invention will become apparent as the following detailed description of the preferred embodiment is read in conjunction with the accompanying drawings which illustrate such preferred embodiment.

DESCRIPTION OF THE PREFERRED EMBODIMENT

Figure 1A:
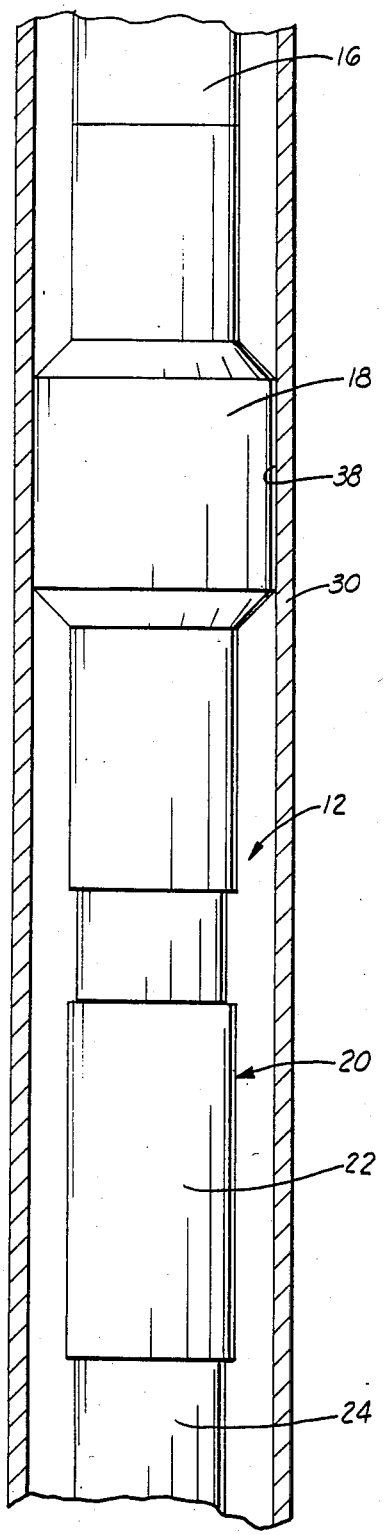
FIGS. 1A–1B show a schematic elevation of the liner seal and screen of the present invention attached to the lower end of a tool string used in a gravel packing operation.
Figure 1B:
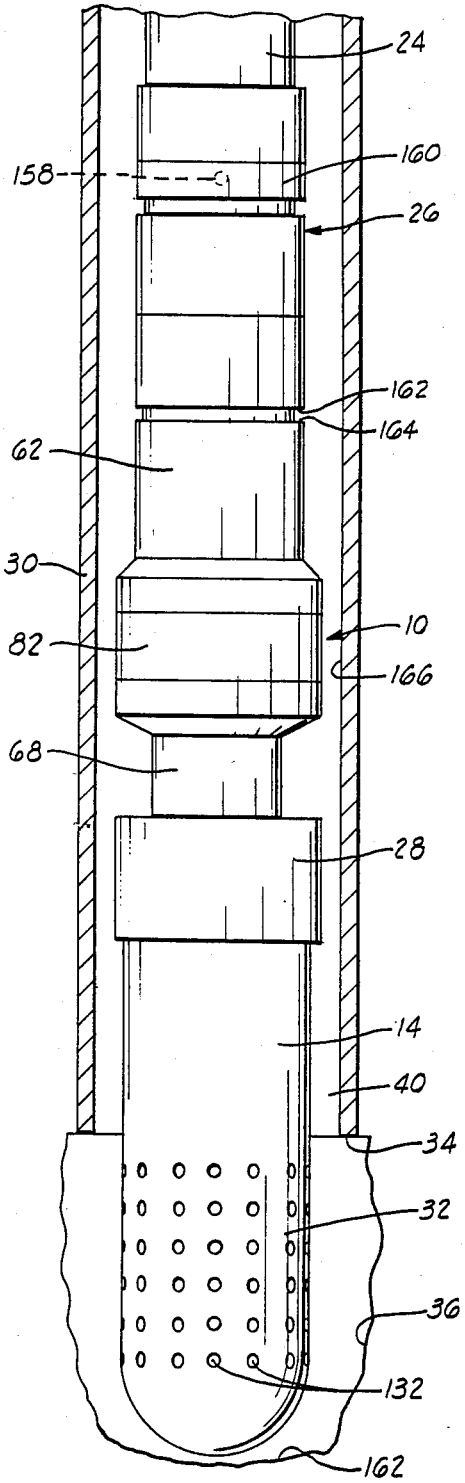
Figure 2A:
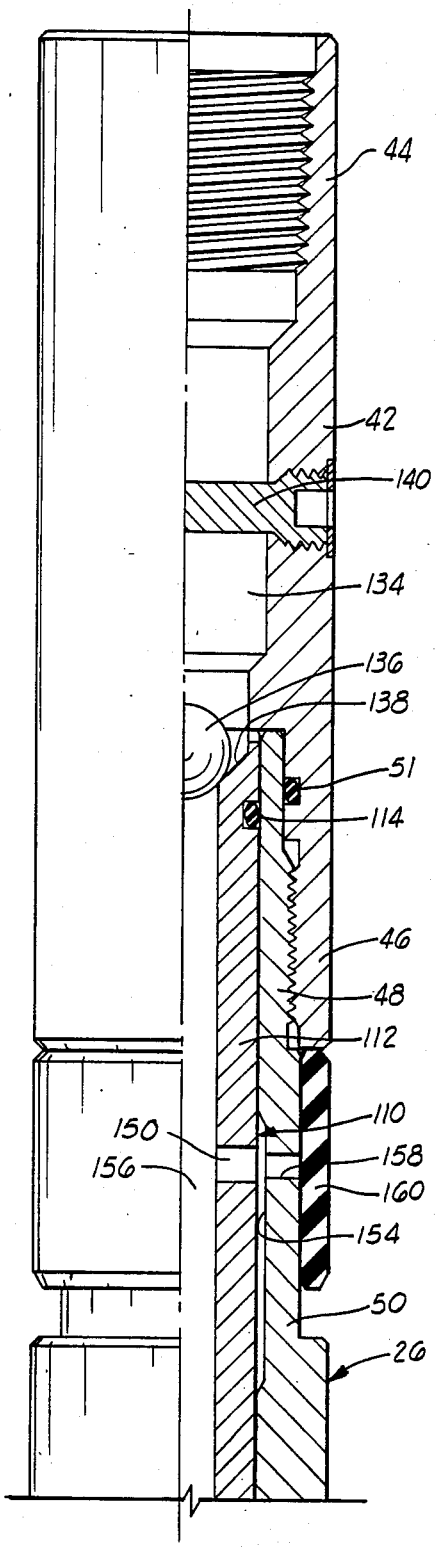
FIGS. 2A–2B illustrate a partial cross section and partial elevation of the apparatus including the release mechanism, liner seal and liner screen.
Figure 2B:
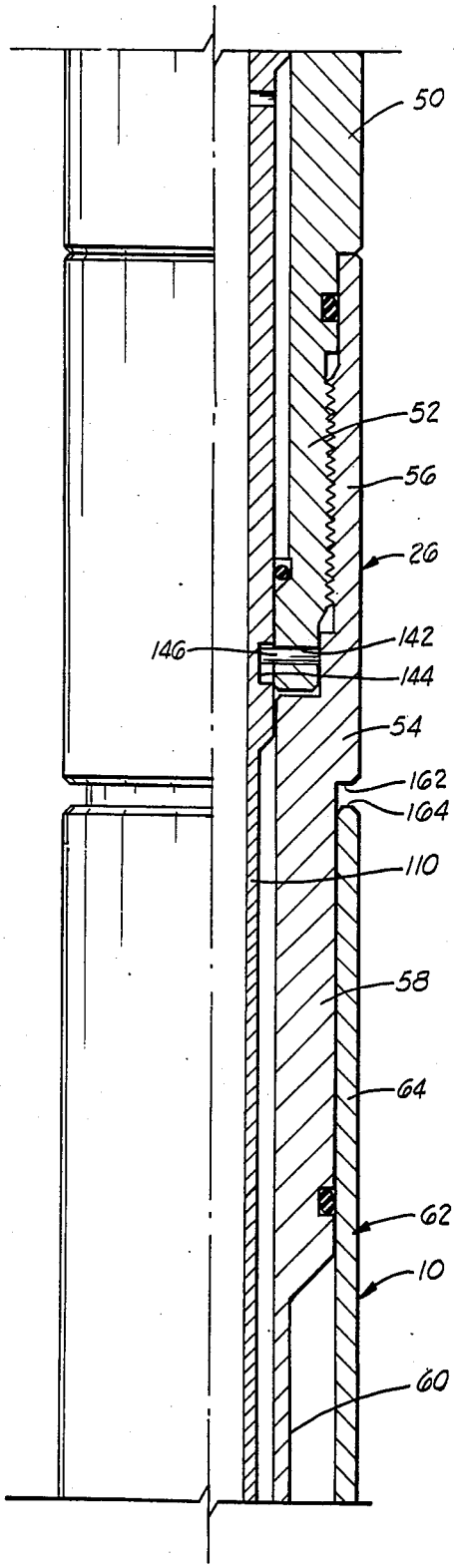
Figure 2C:
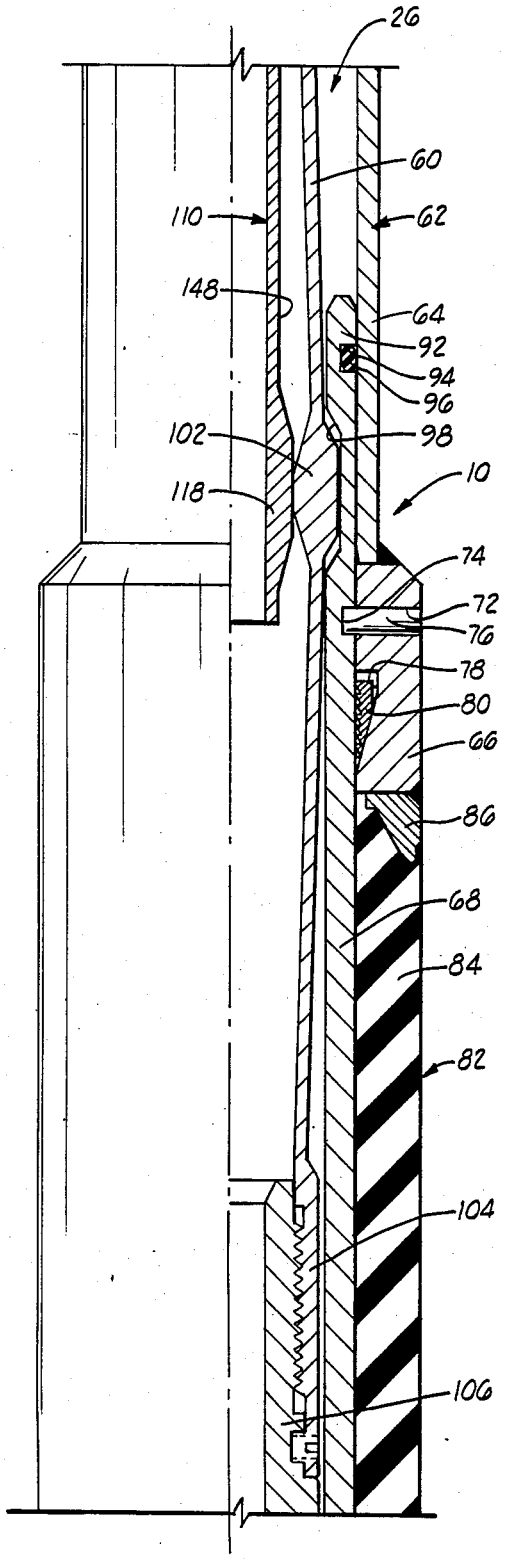
FIG. 2E also shows the well bore.
Figure 2D:
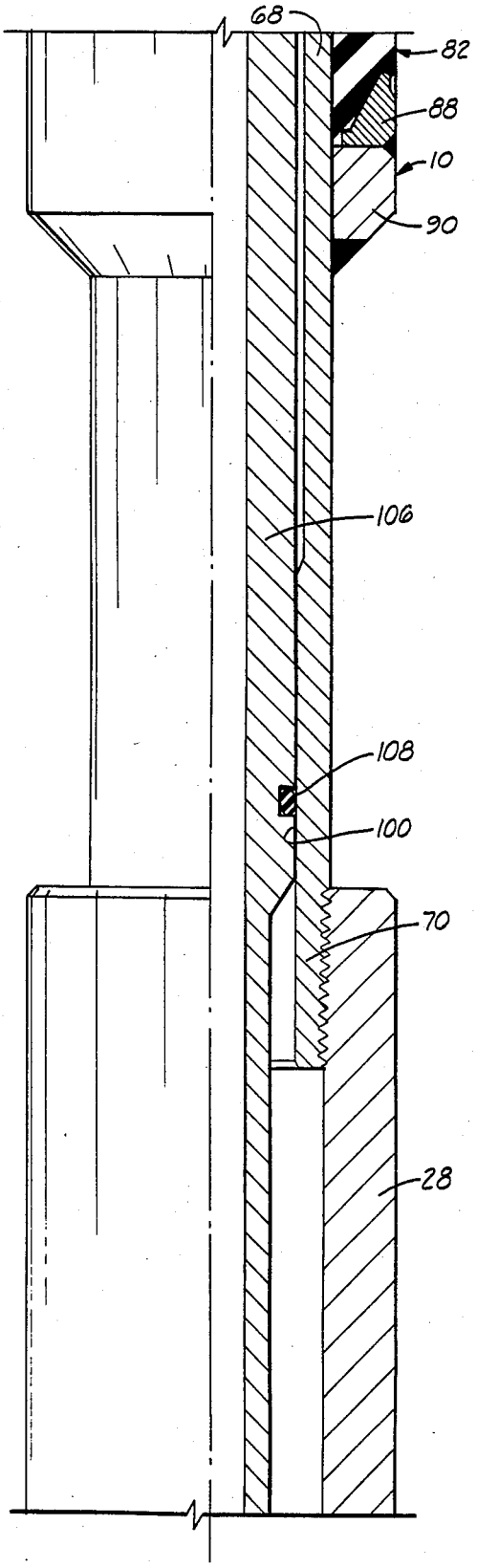
Figure 2E:
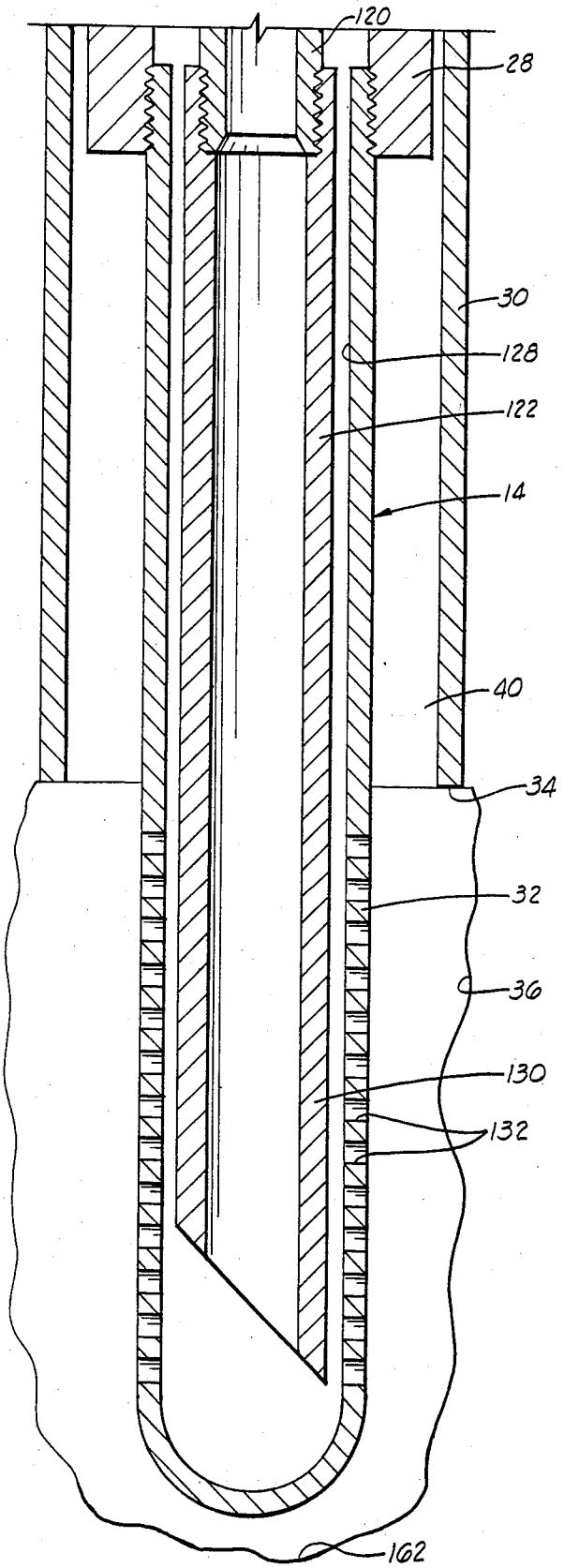

Referring nwo to the drawings, and particularly to FIGS. 1A and 1B, the liner seal of the present invention is shown and generally designated by the numeral 10 as being connected to the lower end of a tool string 12 at a point above a liner screen or gravel screen 14.

Tool string 12 has an upper portion 16 connected to a gravel packer 18 of a kind known in the art. Connected to the lower end of gravel packer 18 is a slip joint 20 having an upper portion 22 and a lower portion 24. Lower portion 24 of slip joint 20 also defines the lower end of drill string 12.

A release mechanism 26 releasably interconnects liner seal 10 with lower portion 24, as hereinafter described.

Liner seal 10 and liner screen 14 form portions of an assembly interconnected by a collar 28.

In FIGS. 1A and 1B, tool string 12, along with liner seal 10 and liner screen 14 connected to the tool string by release mechanism 26, are shown in a position in a well casing 30. As shown, a perforated lower portion 32 of liner screen 14 extends below a lower end 34 of well casing 30 into an unlined portion 36 of the well bore. However, liner screen 14 may be positioned wherever desired in the well, and the invention is not limited to the configuration of FIGS. 1A and 1B.

Gravel packer 18 is illustrated in a set position engaged with inner surface 38 of well casing 30. Inner surface 38 also defines a portion of the well bore. With gravel packer 18 in this set position, gravel may be pumped down and packed in annular volume 40 between liner screen 14 and the well bore in a manner known in the art.

Referring now to FIGS. 2A–2E, details of release mechanism 26, liner seal 10 and liner screen 14 are shown.

Release mechanism 26 has a collar portion 42 with an upper threaded end 44 engaged with lower end 24 of slip joint 20. Collar portion 42 also has a lower threaded end 46 engaged with an upper threaded end 48 of a sleeve portion 50. An O-ring 51 is used as a seal between collar portion 42 and sleeve portion 50.

Sleeve portion 50 has a lower threaded end 52 engaged with a body portion 54 at an upper end 56 thereof. Body portion 54 has an intermediate portion 58 below which a plurality of collet fingers 60 downwardly extend.

Liner seal 10 includes an outer sleeve 62 which includes an upper cylindrical portion 64 and an enlarged lower end 66. Positioned in outer sleeve 62 and extending from lower end 66 thereof in an inner sleeve 68. Inner sleeve 68 has a threaded lower end 70 engaged with collar 28. Outer sleeve 62 and inner sleeve 68 are relatively slidable from the extended position in the drawings to a relatively converged position as hereinafter described.

Lower end 66 of outer sleeve 62 defines a hole 72 therethrough which is aligned with a radially outer groove 74 on inner sleeve 68. A shear pin 76 is positioned in hole 72 and extends into groove 74. In the preferred embodiment, a predetermined weight must be applied to outer sleeve 62 so that shear pin 76 is sheared and outer sleeve 62 is longitudinally downwardly moved with respect to inner sleeve 68.

Although outer sleeve 62 is slidable with respect to inner sleeve 68 in the preferred embodiment, it will be obvious to those skilled in the art that liner seal 10 could be reversed so that the inner sleeve would be slidable with respect to the outer sleeve. Thus, the apparatus includes outer and inner sleeve means which are relatively slidable when a sufficient load is relatively applied therebetween.

Lower end 66 of outer sleeve 62 defines slip retaining groove 78 therein in which is positioned an annularly disposed slip 80. Slip 80 provides means allowing relatively downward movement of outer sleeve 62 with respect to inner sleeve 68, but preventing reverse movement of the outer sleeve. In other words, as the outer sleeve 62 and inner sleeve 68 of liner seal 10 are relatively moved from the normal, extended position shown in the drawings to the relatively converged position, slip 80 will maintain the outer and inner sleeves in the relatively converged position.

A seal member 82 is annularly positioned around inner sleeve 68. Seal member 82 includes a resilient body portion 84, a first, upper end 86 engaged with outer sleeve 62 and a second, lower end 88 engaged with inner sleeve 68. In the preferred embodiment, upper end 86 is attached to lower end 66 of outer sleeve 62, and lower end 88 is attached to enlarged intermediate portion 90 of inner sleeve 68.

Upper end 92 of inner sleeve 68 defines a seal cavity 94 having a sealing member 96, such as an O-ring, disposed therein. Seal 96 provides means for sealing engagement between outer sleeve 62 and inner sleeve 68 regardless of the relative position therebetween.

Upper end 92 of inner sleeve 68 also defines collet receiving means in the form of an annular collet receiving groove 98. Lower end 70 of inner sleeve 68 defines a collet guide surface 100.

Each collet finger 60, extending downwardly from intermediate portion 58 of body portion 54 of release mechanism 26, defines a collet portion 102 at an intermediate point therealong. Originally, collets 102 are aligned with collet receiving groove 98. Collet fingers 60 bias collets 102 radially inwardly away from engagement with collet receiving groove 98.

Below collet fingers 60 is a lower end 104 threadingly engaged with a collet guide sleeve 106 which is guided by collet guide surface 100. A seal 108 is provided for sealing engagement between collet guide sleeve 106 and collet guide surface 100.

A centrally disposed releasing mandrel 110 in release mechanism 26 has an upper end 112 adapted for sliding and guiding engagement with sleeve portion 50 and body portion 54. Seal 114 provides sealing engagement. Mandrel 110 has an enlarged lower end 118 which is engageable with collets 102, and in the original position shown in the drawings, acts as a collet displacing portion for outwardly biasing the collets into engagement with collet receiving groove 98. In this way, collet means are provided on tool string 12 for engaging liner screen 14. Instead of employing collet fingers 60 with a radially inward bias, non-biased fingers may be employed and enlarged lower end 118 of mandrel 110 used to back up collets 102 to maintain them in receiving groove 98. When mandrel 110 is shifted, an upward pull would then cause the unsupported collets 102 to flex fingers 60 inwardly, disengaging collets 102 from groove 98.

Threadingly engaged with a lower end 120 of collet guide sleeve 106 is a wash pipe or tail pipe 122 which extends downwardly into liner screen 14. A lower end 130 of tail pipe 122 is adjacent holes 132 in lower portion 32 of liner screen 14.

OPERATION OF THE APPARATUS

Once tool string 16 is positioned at the desired location within the well bore, the gravel packing operation is carried out in a manner known in the art. Gravel packer 18 is set, and a predetermined amount of gravel is pumped into annular volume 40 with a squeezing operation carried out.

After the gravel packing operation, release mechanism 26 may be actuated to release liner seal 10 and liner screen 14 from tool string 16. In the preferred embodiment, release mechanism 26 is a pressure actuated, non-rotational release device. Fluid is pumped down tool string 16 into central passageway 134 of release mechanism 26. Fluid pressure causes a ball 136 to seat on chamfered seating surface 138 of mandrel 110. A pin 140 extends into central passageway 134, preventing undesired upward movement of ball 136 during reverse flow through the apparatus.

Lower end 52 of sleeve portion 50 defines a hole 142 aligned with a radially outer groove 144 on mandrel 110. A shear pin 146 is disposed in hole 142 and extends into groove 144. Shear pin 146 will be sheared upon application of sufficient downward force on mandrel 110 exerted by the fluid pressure in central passageway 134. At this point, mandrel 110 is free to move downwardly with respect to liner seal 10. Downward movement of mandrel 110 causes lower, collet dissplacing end 118 thereof to move downwardly with respect to colles 102. When lower end 118 is below collets 102, collet fingers 60 inwardly bias the collets toward outer surface 148 of mandrel 110. Collets 102 are thus disengaged from collet receiving groove 98.

Mandrel 110 defines a transverse opening 150 therein. Thus, the pressures in annular cavity 154 and in central opening 156 of mandrel 110 are equalized. Further downward movement of mandrel 110 brings seal 114 into alignment with annular cavity 154 so that the annular cavity is in fluid communication with central passageway 134. Fluid pressure in central passageway 134 is relieved through transverse opening 158 in sleeve portion 50 by outwardly displacing an elastomeric reversing boot 160. This pressure relief stops downward movement of mandrel 110 and is detectable at the surface by well operators.

It will be clear to those skilled in the art that if liner screen 14 is positioned in contact with bottom well surface 162, the releasing operation above described may be carried out prior to the gravel packing operation. In either case, after mandrel 110 releases collets 102 from engagement with collet receiving groove 98, tool string 12 is free to be raised when desired, and the assembly of liner seal 10 and gravel screen 14 will remain in position in the well bore.

Once the gravel is packed and settled in annular volume 40, it is at a level below seal member 82 of liner seal 10. Gravel packer 18 is unset, and liner seal 10 may then be actuated to a set position, sealingly engaging the well bore.

Setting of liner seal 10 is accomplished by setting weight on outer sleeve 62. Tool string 16 is lowered until slip joint 20 is collapsed. Downward force on tool string 16 will then bring shoulder 162 on body portion 54 of releasing mechanism 26 into contact with upper surface 164 of cylindrical portion 64 of outer sleeve 62. When sufficient weight is applied, shear pin 76 will shear so that outer sleeve 62 is moved longitudinally downwardly with respect to inner sleeve 68 to the relatively converged position hereinbefore described. This downward movement obviously causes upper end 86 and lower end 88 of seal member 82 to move closer together which displaces elastomeric body portion 84 radially outwardly into sealing engagement with inner surface 166 of the well bore adjacent thereto. Slips 80 prevent upward movement of outer sleeve 62, and thus prevent disengagement of seal member 82 from surface 166.

Tool string 12 with releasing mechanism 26 still forming a portion thereof may then be raised from the hole, leaving liner seal 10 in sealing engagement with the well bore and liner screen 14 gravel packed therebelow. Liner seal 10 thus sealingly encloses an upper end of annular volume 40 preventing upward migration of the gravel. Because liner seal 10 is part of the original tool string, an additional trip down the hole to position and set a separate seal liner is not required, thus greatly reducing the time and expense involved.

It can be seen, therefore, that the liner seal and method of use of the present invention are well adapted to carry out the ends and advantages mentioned as well as those inherent therein. While a presently preferred embodiment of the apparatus has been shown for the purposes of this disclosure, numerous changes in the construction and arrangement of the parts can be made by those skilled in the art. All such changes are encompassed within the scope and spirit of this invention as defined by the appended claims.

What is claimed is:

1. A liner seal and screen apparatus positionable in a well bore, said apparatus comprising:

a gravel screen portion; and a liner seal portion above said gravel screen portion comprising:

outer sleeve means;

inner sleeve means extending from said outer sleeve means, one of said outer and inner sleeve means being attached to said gravel screen portion, said outer and inner sleeve means being relatively slidable from a normally extended position to a relatively converged position;

annular sleeve means having a first end engaged with said outer sleeve means and a second end engaged with said inner sleeve means, said seal means being radially outwardly displaced into sealing engagement with said well bore when said outer and inner sleeve means are in said relatively converged position;

a tool string portion above said liner seal portion; and releasing means for releasably connecting said line screen portion with said tool string portion comprising:

collet receiving means defined on one of said outer and inner sleeve means of said liner seal portion;

collet means on said tool string portion, at least a portion of said collet means being positionable adjacent said collet receiving means; and mandrel means for biasing said collet means into engagement with said collet receiving means when in a connecting position and releasing said collet means from said engagement when in a releasing position.

2. The apparatus of claim 1 further comprising slip means for lockably holding said outer and inner sleeve means in said relatively converged position.

3. The apparatus of claim 1 further comprising shear means for maintaining said outer and inner sleeve means in said extended position, said shear means being shearable upon application of a predetermined load relatively applied between said outer and inner sleeve means.

4. The apparatus of claim 1 wherein said collet means are normally biased away from engagement with said collet receiving means.

5. A downhole tool for use in a tool string, said downhole tool comprising:

a liner screen for location at a predetermined position in a well bore;

a liner seal attached to an upper end of said liner screen and defining a set position sealingly engaged with said well bore for sealing an upper portion of an annular volume between said liner screen and said well bore; said liner seal comprising:

an inner sleeve having a lower end connected to said liner screen, an upper end, and an inside surface defining an annular collet receiving groove therein;

an outer sleeve slidingly disposed around said inner sleeve upper end, said outer sleeve having an upper and a lower end; and an annular sealing member having an upper end attached to said outer sleeve lower end and a lower end attached to said inner sleeve at an intermediate position thereon, said sealing member being radially outwardly deflected into sealing engagement with said well bore when said outer sleeve is moved from an original position to a relatively converged position with respect to said inner sleeve, said converged position corresponding to said liner seal set position, such that said upper and lower ends of said annular sealing member are moved toward one another; and a releasing mechanism for attaching said liner seal to said tool string and non-rotationally releasing said liner seal from said tool string such that said tool string may be removed from said well bore with said liner seal and said liner screen remaining positioned in said well bore, said releasing mechanism comprising:

a body portion attached to said tool string and having a plurality of collet fingers extending downwardly therefrom, each collet finger defining a collet portion, said collet portions being adjacent said groove when in an original position; and a releasing mandrel slidably positioned in said body portion and having a collet displacing portion at a lower end thereof for outwardly displacing said collet portions into engagement with said groove when in an engaging position;

whereby, as said releasing mandrel is moved from said engaging position to a releasing position, said collet displacing portion is moved away from said collet portions such that said collet portions are disengaged from said groove and thereby release said liner seal from said tool string.

6. The apparatus of claim 5 wherein said releasing mechanism further comprises shear means between said body portion and said releasing mandrel such that a predetermined force is required for moving said releasing mandrel from said engaging position to said releasing position.

7. The apparatus of claim 5 wherein said releasing mechanism further comprises shoulder means between said body portion and said releasing mandrel, limiting maximum relative movement between said body portion and said releasing mandrel.

8. The apparatus of claim 5 wherein said collet fingers are inwardly biased from said collet receiving groove.

9. The apparatus of claim 5 further comprising a slip positioned between said outer and inner sleeves for allowing movement of said outer sleeve from said original position to said relatively converged position and preventing reverse movement of said outer sleeve.

10. The apparatus of claim 5 further comprising shear means between said outer and inner sleeves such that a predetermined force is required for moving said outer sleeve from said original position to said relatively converged position.

11. A method of positioning and packing a liner screen in a well bore, said method comprising the steps of:

releasably connecting a liner seal to a lower end of a tool string;

engaging said liner screen with a lower end of said liner seal;

lowering said tool string into said well bore and locating said screen at a predetermined position in said well bore;

packing gravel below said liner seal in an annular volume between said screen and said well bore;

releasing said liner seal from said tool string by applying pressure to a pressure actuated release mechanism interconnecting said liner seal with a lower end of said tool string, thereby displacing a plurality of collets from a first position engaging said liner seal to a second position releasing said liner seal;

setting said liner seal for sealing engagement with said well bore and thereby sealingly enclosing an upper portion of said annular volume; and preventing disengagement of said liner seal from said well bore.

12. The method of claim 11 wherein said step of setting said liner seal comprises setting weight on a first portion of said liner seal for longitudinal displacement of said first portion with respect to a second portion of said liner seal for radially deflecting a sealing member on said liner seal into said sealing engagement with said well bore.

13. The method of claim 12 further comprising positioning shear means between said first and second liner seal portions for interconnection thereof, such that a predetermined weight is required for said longitudinal displacement.

14. The method of claim 12 wherein said step of preventing disengagement of said liner seal comprises positioning slip means between said first and second liner seal portions for allowing said longitudinal displacement and preventing reverse movement between said first and second liner seal portions.

* * * * *

UNITED STATES PATENT AND TRADEMARK OFFICE

CERTIFICATE OF CORRECTION

PATENT NO. : 4,662,446

DATED : May 5, 1987

INVENTOR(S) : David P. Brisco and Michael L. Bolin

It is certified that error appears in the above-identified patent and that said Letters Patent is hereby corrected as shown below:

Column 1, line 48 delete "rleasing" and insert --releasing-- therefor.
Column 2, line 2 delete "converted" and insert --converged-- therefor.
Column 4, line 22 delete "nwo" and insert --now-- therefor.
Column 7, line 64 delete ''sleeve' and insert --seal--therefor.

Signed and Sealed this

Eighteenth Day of August, 1987

*Attest:*

*Attesting Officer*

DONALD J. QUIGG

*Commissioner of Patents and Trademarks*